US005669426A

United States Patent [19]

Fontaine, Jr.

[11] Patent Number: 5,669,426

[45] Date of Patent: Sep. 23, 1997

[54] DISPENSING DEVICE

[75] Inventor: Walter G. Fontaine, Jr., Narragansett, R.I.

[73] Assignee: Colibri Corporation, Providence, R.I.

[21] Appl. No.: 667,404

[22] Filed: Jun. 21, 1996

[51] Int. Cl.[6] ..... B65B 1/04; B65B 3/24; B65B 31/00; B67C 3/00

[52] U.S. Cl. ..... 141/21; 141/348; 141/351; 141/352; 141/353; 137/614.17

[58] Field of Search ..... 141/18, 21, 348, 141/349, 351–353, 357, 360, 363, 364, 366, 367, 379, 296, 293, 291, 292; 137/322, 614.04, 611.11, 614.17

[56] References Cited

U.S. PATENT DOCUMENTS

| | | | |
|---|---|---|---|
| 2,881,810 | 4/1959 | Breitenstein | 141/353 |
| 2,989,091 | 6/1961 | Lowenthal | 141/18 |
| 3,144,057 | 8/1964 | O'Donnell | 141/354 |
| 3,653,416 | 4/1972 | Hocq | 141/353 |
| 3,705,785 | 12/1972 | Goto | 431/344 |
| 4,250,934 | 2/1981 | Wada | 141/357 |

*Primary Examiner*—Renee S. Luebke
*Assistant Examiner*—Timothy L. Maust
*Attorney, Agent, or Firm*—Salter & Michaelson

[57] ABSTRACT

A dispensing device for dispensing pressurized gas from a canister includes a first, outer valve having a valve body disposed within a chamber of a housing and an annular valve stem extending away from the valve body through an opening of a formation of the canister. The outer valve is movable between an open position in which fluid communication between the interior region of the canister and a chamber of the outer valve body is achieved, and a closed position. A spring is provided for biasing the outer valve to its closed position. A second, inner valve is disposed within the outer valve, the inner valve having a valve member and a valve stem extending away from the valve member. The valve stem of the inner valve is disposed within the valve stem of the outer valve and extends coaxially therewith. The inner valve is movable between an open position in which the valve member of the inner valve is moved relative to the valve stem of the outer valve to allow fluid communication between the outer valve and atmosphere, and a closed position. Another spring is provided for biasing the inner valve to its closed position.

9 Claims, 3 Drawing Sheets

DISPENSING DEVICE

BACKGROUND AND SUMMARY OF THE INVENTION

This invention relates generally to dispensing devices, and more particularly to a dispensing device for a butane canister.

Dispensing devices for dispensing pressurized liquid or gas from one container to another are well-known in the art. In this regard, U.S. Pat. Nos. 2,989,091 to Lowenthal, 3,705,785 to Goto, and 3,653,416 to Hocq represent the closest prior art to the subject matter of the instant invention. Specifically, each of these patents disclose a dispensing device having a valve assembly for dispensing pressurized fluid or gas from a canister upon which it is attached.

While the dispensing devices disclosed in the above-identified patents are effective for their intended purposes, there is presently a need for a dispensing device that makes it difficult, if not impossible, for a person to actuate the flow of liquid or gas from the container for purposes other than dispensing the liquid or gas from the container to another container. More particularly, for containers having a supply of butane for cigarette lighters, for example, it is known that individuals inappropriately actuate the dispenser of the container for the purpose of sniffing the butane.

The instant invention is directed to an improved dispensing device for dispensing pressurized gas from a canister of the type having cylindrical wall and a formation at the upper end of the cylindrical wall for receiving and securing the dispensing device through an opening formed in the formation. The dispensing device comprises a cup-shaped housing having bottom wall and a peripheral wall that extends from the bottom wall to define a chamber. The peripheral wall of the housing is attached to the formation of the canister in a position that peripheral and bottom walls of the housing extends into the canister. The device further comprises a first, outer valve having a valve body disposed within the chamber of the housing and an annular valve stem extending away from the valve body through the opening of the formation of the canister. The first valve is movable between an open position in which fluid communication between the interior of the canister and the annular stem is achieved and a closed position in which fluid communication therebetween is blocked. Suitable means is provided for biasing the first valve to its closed position. A second inner valve is disposed within the annular stem of the first valve wherein the second valve has a valve member and a valve stem extending away from the valve member. The valve stem of the second valve is disposed within the valve stem of the first valve and extends coaxially therewith. The second valve is movable between an open position in which the valve member of the second valve is moved relative to the valve stem of the first valve to allow fluid communication between the valve stem of the first valve and atmosphere, and a closed position. Suitable means is provided for biasing the second valve to its closed position. The arrangement is such that upon movement of the first valve to its open position and movement of the second valve to its open position, pressurized gas within the canister is exhausted from the canister to atmosphere.

Accordingly, among the several objects of the present invention are the provision of an improved dispensing device for a butane canister which operates only when connected to a lighter having a fluid fill tube; the provision of such a dispensing device that makes it difficult, if not impossible, for people to actuate the flow of gas from the canister for illicit purposes; the provision of such an improved dispensing device which is easy and reliable to operate; and the provision of such a dispensing device which is sturdy in construction and substantially tamper resistant.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
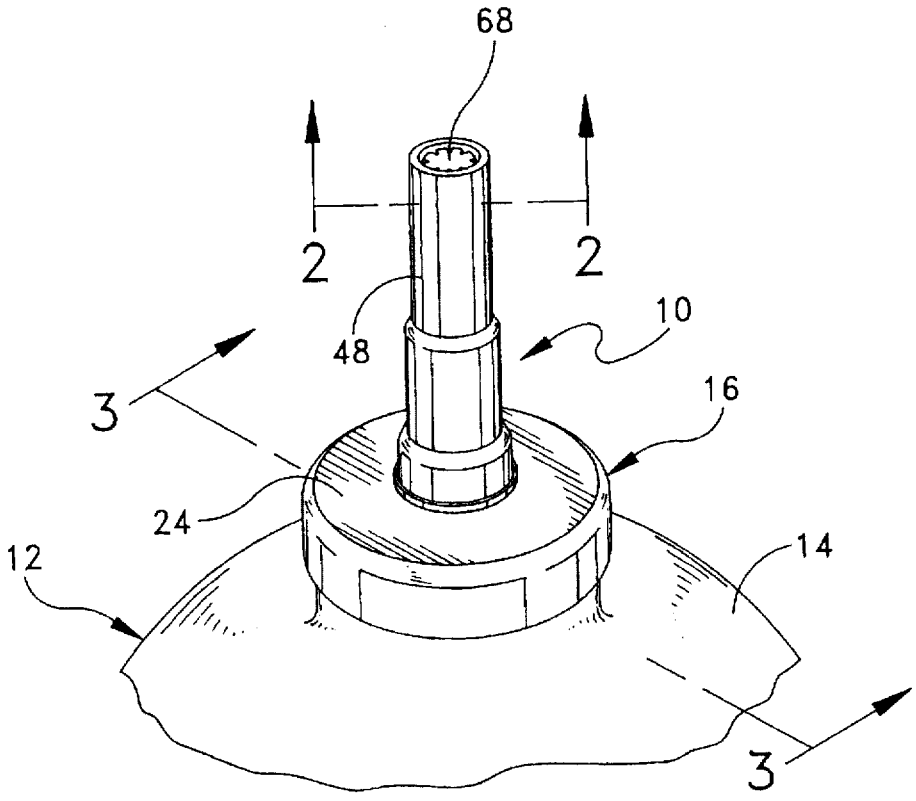
FIG. 1 is a perspective view of a dispensing device of the present invention mounted on a butane canister.

Referring now to the drawings, and more particularly to FIG. 1, there is generally indicated at 10 a dispensing device of the present invention which mounts on the upper end of a pressurized canister, generally indicated at 12. The device 10 is capable of dispensing pressurized liquid or gas contained within the canister 12 upon actuating the device in a particular manner which will be described below. Preferably, the device 10 is for dispensing butane gas pressurized within the canister 12; however, it should be understood that the device 10 of the present invention is suitable for mounting on any type of canister or container and for dispensing liquid or gas therefrom, and still fall within the scope of the present invention.

Figure 3:
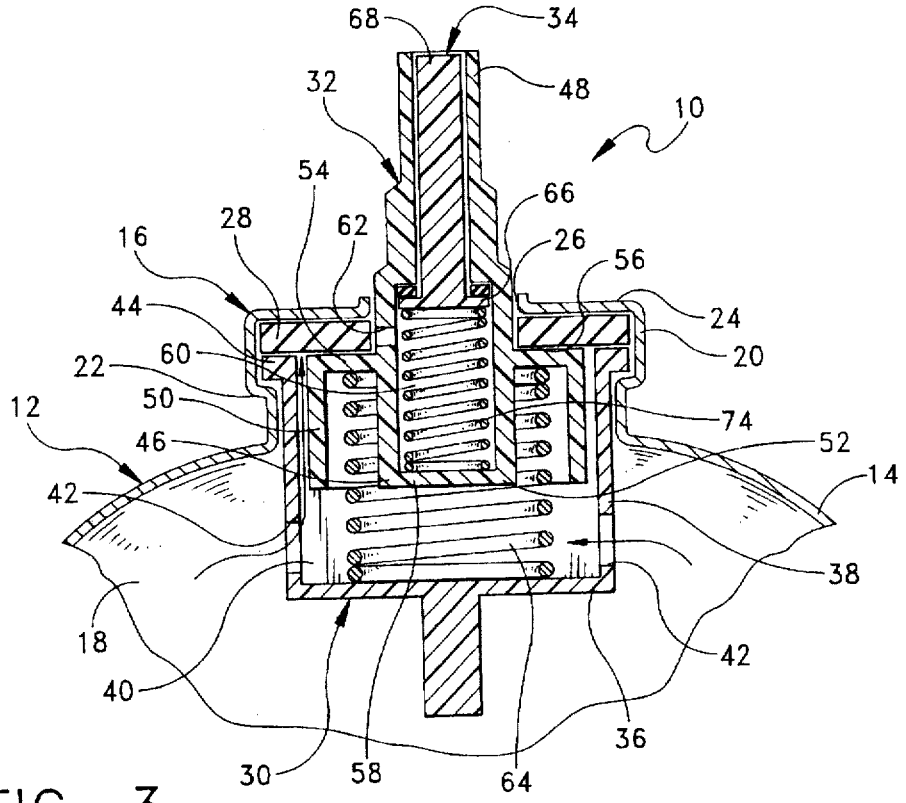
FIG. 3 is a cross-sectional view taken along line 3—3 of FIG. 1.

Referring to FIGS. 1 and 3, the canister 12 includes a cylindrical wall 14 which is tapered at its upper end to a formation, generally indicated at 16, which receives and secures thereto the dispensing device 10. The cylindrical wall 14 of the canister 12 defines an interior region 18 for storing pressurized fluid therein (e.g., butane). More specifically, the formation 16 comprises a vertical wall portion 20 having a step 22 formed therein and a horizontal portion 24 wall having an opening 26 formed therein for receiving the dispensing device 10. An elastomeric seal or gasket 28 is provided within a channel (not designated) formed by the horizontal wall portion 24 and vertical wall portion 20 in a position in which it is adjacent the horizontal wall portion for sealing the interior region 18 of the canister 12 from atmosphere. As shown in FIG. 3, the device 10 is captured between the step 22 of the vertical wall portion 20 and the horizontal wall portion 24 of the formation 16 for securely mounting the device 10 to the canister 12. It should be understood that the dispensing device 10 can be attached to the canister 12 in any other suitable manner and still fall within the scope of the present invention.

Referring to FIGS. 3–6, the dispensing device 10 comprises a cup-shaped housing, generally indicated at 30, an outer ("first") valve, generally indicated at 32, which is disposed within the housing, and an inner ("second") valve, generally indicated at 34, which is disposed within the outer valve. As shown, the housing 30 has a bottom wall and a cylindrically-shaped peripheral wall 38 that extends upwardly from the bottom wall to define a chamber 40 which receives the outer valve 32 therein. There is a pair of apertures 42 formed in the peripheral wall 38 of the housing 30 for allowing fluid communication between the interior region 18 of the canister 12 and the chamber 40 of the housing 30. At the upper edge of the peripheral wall 38 there is an outwardly extending flange 44 that is received between the step 22 and the horizontal wall portion 24 of the formation 16 of the canister 12. The housing 30 is held in place and securely mounted on the canister 12 by virtue of the step 22 and horizontal wall portion 24 of the formation 16 which together sandwich the flange 44 of the housing and the seal 28 therebetween.

Figure 5:
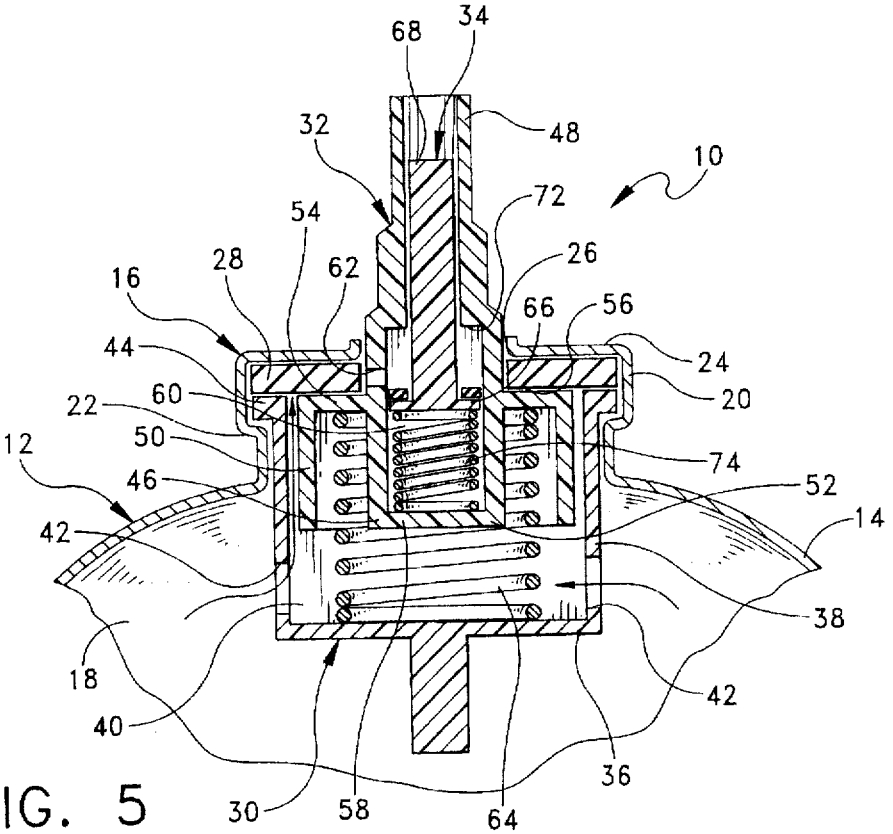
FIG. 5 is a view similar to FIGS. 3 and 4 illustrating a second valve of the device in an open position.

The outer valve 32 has a valve body 46 disposed within the chamber 40 of the housing 30 and an elongate, annular valve stem 48 extending upwardly from the valve body 46 through the opening 26 of the formation 16 of the canister 12. The valve body 46 includes an outer annular wall 50 that is attached to an inner annular wall 52 by means of a horizontal connecting wall 54 that is integrally formed with the upper end of the outer annular wall and the inner annular wall. As shown in FIGS. 3 and 5, the elastomeric seal 28 defines a valve seat 56 upon which the connecting wall 54 engages for blocking fluid communication, which will be described in greater detail below. The valve body 46 of the outer valve 32 further includes a lower horizontal end wall 58, which, along with the inner annular wall 52, defines a valve chamber 60 that slidably receives the inner valve 34 therein.

Figure 4:
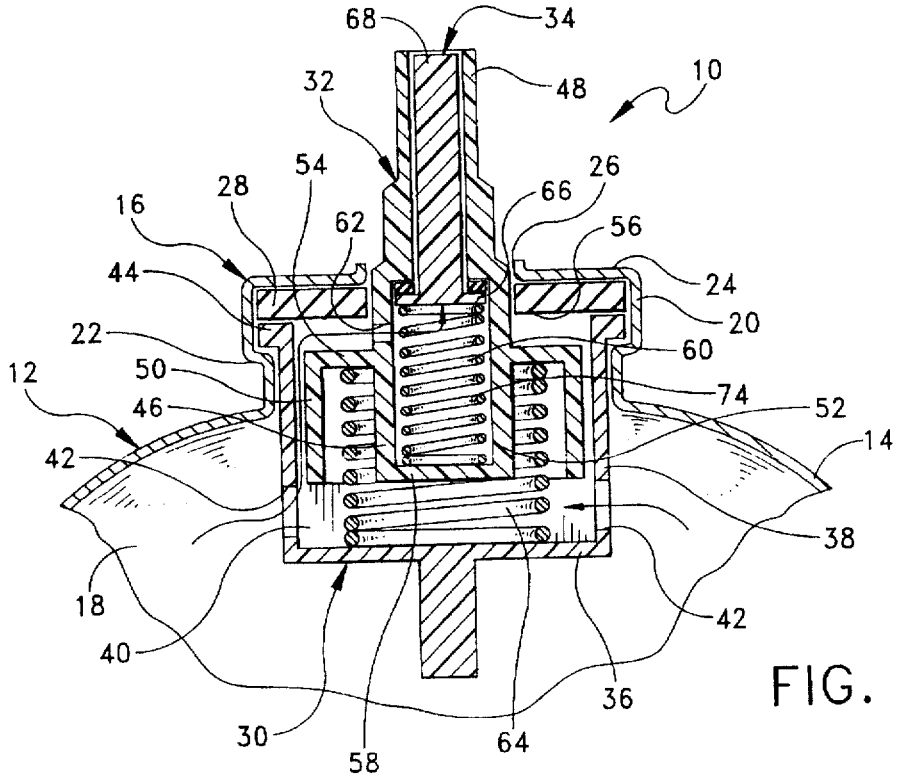
FIG. 4 is a view similar to FIG. 3 illustrating a first valve of the device in an open position.
Figure 6:
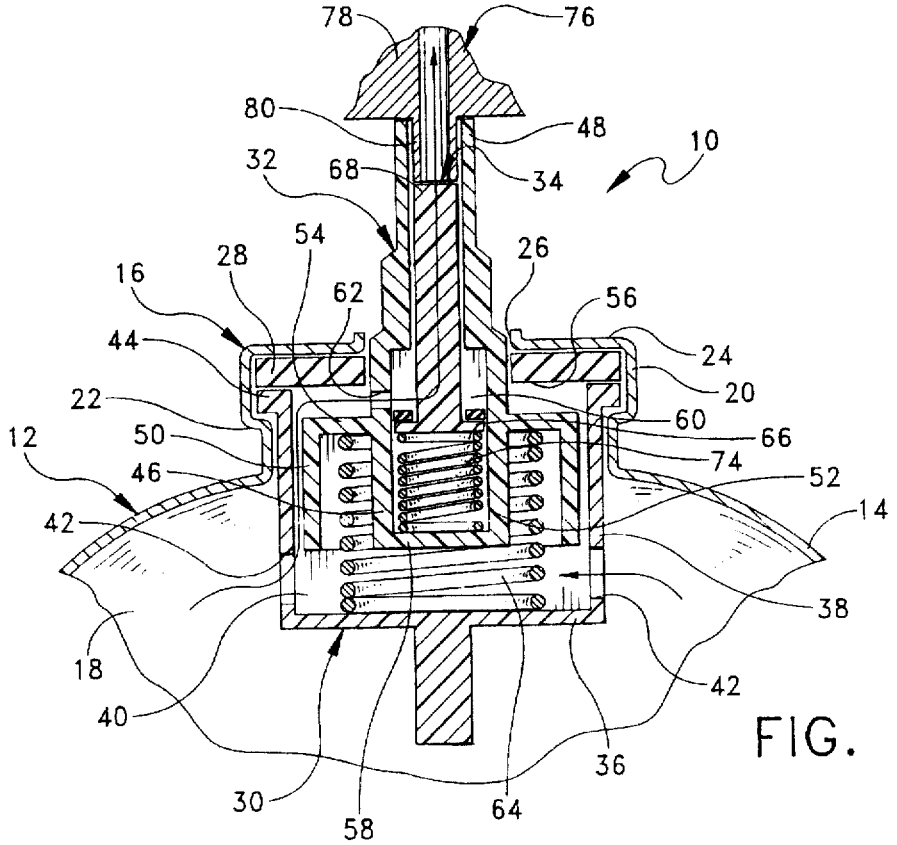
FIG. 6 is a view similar to FIGS. 3–5 illustrating the first and second valves in their open positions.

As shown, the valve body 46 and the annular stem 48 of the outer valve 32 are formed integrally as one-piece. The outer valve 32 is movable between an open position in which fluid communication between the chamber 40 of the housing 32 and the valve chamber 60 is achieved, and a closed position in which fluid communication therebetween is blocked. FIGS. 4 and 6 illustrate the outer valve 32 in its open position. As shown, there is an aperture 62 formed in the inner annular wall 52 which, when the outer valve 32 is in its open position, the aperture 62 provides fluid communication between the chamber 40 of the housing and the valve chamber 60. FIGS. 3 and 5 illustrate the outer valve 32 in its closed position wherein the upper horizontal connecting wall 54 engages the elastomeric seal 28 and the aperture 62 spaced above the chamber 40 of the housing 30 for blocking fluid communication between the chamber and the valve chamber 60.

A spring 64 is disposed within the chamber 40 of the housing 30 in a position between the outer and inner annular walls 50, 52 of the valve body 46 of the outer valve 32 for biasing the outer valve to its closed position. The spring 64 is a helical spring and is of sufficient strength to maintain the outer valve 32 in its closed position, but resilient enough so that when a nominal downward force is exerted on the valve stem 48 of the outer valve, the valve can move to its open position against the bias of the spring. As shown, the spring 64 engages the bottom wall 36 of the housing 30 and the horizontal connecting wall 54 of the valve body 46 of the outer valve 32 for biasing the outer valve 54 towards the valve seat 56.

Movement of the outer valve 32 to its open position is achieved by forcing the valve stem 48 of the outer valve downwardly against the bias of the spring 64 in the manner depicted in FIGS. 4 and 6. Once the valve body 46 is moved away from the elastomeric seal 28, and the aperture 62 formed in the inner annular wall 52 of the valve body is exposed, pressurized gas from the interior region 18 of the canister 12 flows from the interior region into the valve chamber 60 of the outer valve. However, the inner valve 34, when in a normally closed position to be discussed in greater detail below, prevents the pressurized gas from escaping from the valve chamber 60 to atmosphere. By releasing the valve stem 48 of the outer valve 32, the spring 64 biases the outer valve to its closed position.

Figure 2:
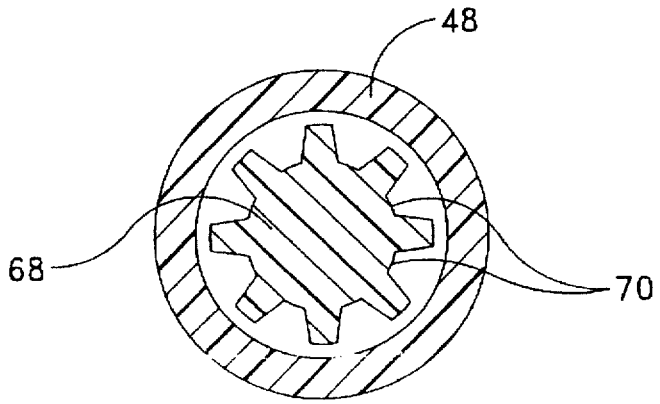
FIG. 2 is a cross-sectional view taken along line 2—2 of FIG. 1.

Still referring to FIGS. 3–6, and also to FIG. 2, the inner valve 34 is slidably movable within the valve chamber 60 of the outer valve 32, and includes a disc-shaped valve member 66 and an elongate valve stem 68 extending upwardly away from the valve member. As shown, the inner valve stem 68 extends up through the annular valve stem 48 of the outer valve 32 along the same axis. As illustrated in FIG. 2, the valve stem 68 of the inner valve 34 has elongate, axially extending channels 70 formed therein for enabling pressurized gas to exit the valve chamber 60. Specifically, the valve stem 68 in cross section is generally star-shaped for enabling the venting of gas from the valve chamber 60 to atmosphere via the channels 70.

The inner valve 34 is movable between an open position in which the valve member 66 of the inner valve is moved downwardly relative to the valve stem 48 of the outer valve 32 to allow fluid communication between the valve chamber 60, the valve stem 48 of the outer valve 34 and the atmosphere (see FIGS. 5 and 6), and a closed position in which valve member 66 of the inner valve 34 engages a valve seat 72 formed in the valve chamber 60 at the junction of the valve body 46 and the valve stem 48 of the outer valve 32 (see FIGS. 3 and 4). As shown in FIGS. 3 and 4, the valve member 66 of the inner valve 34 is positioned above the aperture 62 so as to block fluid communication between the valve chamber 60 and the valve stem 48 of the outer valve 32 (and atmosphere), and by moving the inner valve 34 to its open position, the valve member 66 is disposed below the aperture 62 so as to allow fluid communication between the valve chamber 60 and the valve stem 48.

Another spring 74, smaller than spring 64, is disposed within the valve chamber 60 of the outer valve 32 for biasing the inner valve 34 to its closed position. As with spring 64, spring 74 is a helical spring and is of sufficient strength to maintain the inner valve 34 in its closed position, but resilient enough so that when a nominal downward force is exerted on the valve stem 68 of the inner valve, the valve 34 can move to its open position against the bias of the spring. As shown, the spring 74 engages the lower end wall 58 of the valve body 46 of the outer valve 32 and the downwardly facing surface of the valve member 66 of the inner valve 34 for biasing the inner valve towards its valve seat 72.

In operation, FIG. 3 depicts the outer and inner valves 32, 34 in their closed positions. As shown, the valve body 46 of the outer valve 32 is biased upwardly towards the valve seat 56 by spring 64 for blocking fluid communication between the chamber 40 of the housing 30 and the valve chamber 60. FIG. 4 illustrates a downward force being exerted on the valve stem 48 of the outer valve 32 only for moving the outer valve to its open position. As shown, the valve body 46 of the outer valve 32 is spaced away from its valve seat 56 thereby allowing pressurized fluid (e.g., butane) to flow from the interior region 18 of the canister 12, into the chamber 40 of the housing 30 (via aperture 42), and into the valve chamber 60 (via aperture 62). It should be noted that the inner valve 34 is in its closed position for blocking fluid communication between the valve chamber 60 and atmosphere. Thus, only by moving the inner valve 34 to its open position along with moving the outer valve to its open position, can pressurized gas from the canister 12 be delivered by the device 10. It is nearly impossible to simultaneously move by hand the outer and inner valves 32, 34 to their open position without the aid of an implement configured specifically for acheiving this purpose. Therefore, it should be observed that the dispensing device 10 of the present invention is difficult to be used for illicit purposes, such as sniffing the contents of the canister 12.

FIG. 5 shows the outer valve 32 in its closed position and the inner valve 34 in its open position. This can be achieved only by utilizing a thin instrument (not shown) having a smaller diameter than the diameter of the valve stem 48 of the outer valve 32, and forcing the valve stem 68 of the inner valve 34 downwardly. As shown, while communication between the valve chamber 60 and atmosphere is achieved, fluid communication between the interior region 18 of the canister 12, the chamber 40 of the housing 30 and the valve chamber 60 is blocked by virtue of the outer valve 32 being closed.

Turning now to FIG. 6, the dispensing device 10 is illustrated for dispensing pressurized fluid or gas from the interior region 18 of the canister 12. As shown, the outer valve 32 is in its open position wherein pressurized fluid from the canister 12 enters the valve chamber 60 via the aperture 62 formed in the valve body 46 of the outer valve 32. Moreover, the inner valve 34 is in its open position thereby allowing fluid communication between the valve chamber 60 and atmosphere via the valve stem 48 of the outer valve 32. As shown in FIG. 6, a butane cigarette lighter generally indicated at 76 having a body portion 78 a downwardly depending fill tube 80 in communication with a storage area (not shown) of the lighter, is used for moving the outer and inner valves 32, 34 to their open position. Specifically, the body portion 78 of the lighter 76 engages the upper end of the valve stem 48 of the outer valve 32 for moving the outer valve to its downwardly disposed, open position. Meanwhile, the fill 80 tube engages the valve stem 68 of the inner valve 34 for moving the inner valve downwardly relative to the outer valve thereby achieving its open position. The fill tube 80 is annularly-constructed so that pressurized fluid (e.g., butane) is dispensed from the canister 12 to the storage area of the lighter 76. Upon filling the lighter 76, the lighter (and fill tube 80) is moved away from the dispensing device 10 whereupon the outer and inner valves 32, 34 move to their closed position.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A dispensing device for dispensing pressurized gas from a canister of the type having a cylindrical wall and a formation at the upper end of the cylindrical wall for receiving and securing the dispensing device through an opening formed in the formation, said dispensing device comprising:

a housing having a wall that defines a chamber, said wall of the housing being attached to the formation of the canister;

a first valve having a valve body disposed within the chamber of the housing and an annular valve stem extending away from the valve body; said first valve being movable between an open position in which fluid communication between the interior of the canister and the annular stem is achieved and a closed position in which fluid communication therebetween is blocked; and means biasing the first valve to its closed position;

a second valve disposed within the first valve, said second valve having a valve member and a valve stem extending away from the valve member, said valve stem of the second valve being disposed within the valve stem of the first valve and extending coaxially therewith, said second valve being movable between an open position in which the valve member of the second valve is moved relative to the valve stem of the first valve to allow fluid communication between the first valve and atmosphere, and a closed position;

means biasing the second valve to its closed position, the arrangement being such that upon movement of the first valve to its open position and movement of the second valve to its open position, pressurized gas within the canister is exhausted from the canister to atmosphere.

2. A dispensing device as set forth in claim 1, said formation of the canister defining a valve seat engagable with the valve body of the first valve when in its closed position, said valve body of the first valve having an outer annular wall, an inner annular wall and a horizontal wall which is attached to the upper end of the outer annular wall with the inner annular wall.

3. A dispensing device as set forth in claim 2, said valve body of the first valve further having a lower horizontal wall attached to the lower end of the inner annular wall, said inner annular wall and lower horizontal wall defining a valve chamber that slidably receives the valve member of the second valve therein.

4. A dispensing device as set forth in claim 3, said valve stem of the first valve having an aperture formed therein, the arrangement being such that when said first valve is in its closed position, the aperture is blocked, and when the first valve is moved to its open position, the aperture provides fluid communication between the chamber of the housing and the valve chamber.

5. A dispensing device as set forth in claim 4, said first valve having a valve seat formed in the valve stem thereof engagable with the valve member when the second valve is in its closed position, and upon moving the second valve to its open position, said valve member is moved away from the valve seat to provide fluid communication between the chamber of the housing, the valve chamber and atmosphere for dispensing pressurized gas from the canister.

6. A dispensing device as set forth in claim 5, said valve member of the second valve, when moved to its open position, being spaced below said aperture in the valve stem of the first valve.

7. A dispensing device as set forth in claim 2, said means biasing the first valve to its closed position comprising a spring disposed within the chamber of the housing and between the outer and inner annular walls of the valve body of the first valve, said spring engaging the bottom wall of the housing and the horizontal wall of the valve body of the first valve for biasing said first valve towards said valve seat.

8. A dispensing device as set forth in claim 5, said means biasing the second valve to its closed position comprising a spring disposed within the valve chamber engagable with the bottom horizontal wall of the valve body of the first valve and the valve member of the second valve for biasing the second valve towards the valve seat.

9. A dispensing device as set forth in claim 5, said valve stem of the second valve having elongate, axially extending channels formed therein for enabling pressurized gas to exit the valve chamber when the second valve is in its open position.

* * * * *